US005873583A

United States Patent [19]

Moore

[11] Patent Number: 5,873,583

[45] Date of Patent: Feb. 23, 1999

[54] IN-LINE ROLLER SKATES

[76] Inventor: James L. Moore, 10510 Boucher, Grosse Ile, Mich. 48138

[21] Appl. No.: 851,945

[22] Filed: May 6, 1997

[51] Int. Cl.[6] ..... A63C 17/04

[52] U.S. Cl. ..... 280/11.21; 280/11.22

[58] Field of Search ..... 280/11.2, 11.21, 280/11.22, 11.23, 11.27

[56] References Cited

U.S. PATENT DOCUMENTS

| | | | |
|---|---|---|---|
| 5,280,931 | 1/1994 | Horton | 280/11.2 |
| 5,308,093 | 5/1994 | Walin | 280/11.2 |
| 5,501,474 | 3/1996 | Conte | 280/11.2 |

*Primary Examiner*—Richard M. Camby

[57] ABSTRACT

An in-line roller skate has a forward control wheel 32 positioned above the surface on which the skate is supported by intermediate wheels 34 and 36. The forward control wheel 32 occasionally contacts the surface during normal skating motion and rotates freely when the skater exerts forward motion through the wheel to the surface. When the skater tilts the skate forward to place the forward control wheel into contact with the surface and exerts rearward forces through the forward wheel to the surface, the bearing assembly 33 of the forward wheel locks the wheel against counterclockwise rotation and enables the skater to apply additional thrusting forces to the surface. A rearward control wheel 38 operates in reverse fashion to provide the skater with braking forces.

10 Claims, 1 Drawing Sheet

IN-LINE ROLLER SKATES

BACKGROUND OF THE INVENTION

1. Field of the Invention

This invention provides in-line roller skates that have a control wheel mounted either forward or rearward of one or more intermediate wheels. The intermediate wheel or wheels provide primary support for the user, and the control wheel provides improved thrusting or braking.

2. Brief Description of the Prior Art

In-line roller skates became popular several years ago and are used widely for pleasure skating and recreational skating. These in-line roller skates are characterized by a construction in which three or more wheels are located longitudinally along the boot of the skate so that all of the wheels rotate in the same rotational plane. In-line skates differ from the more conventional roller skate that has front and rear axles with wheels at the ends of each axle; in the conventional skate the wheels on the left side of the axles rotate in the same rotational plane while the wheels on the right side rotate in a parallel but different rotational plane.

In-line roller skates offer greater skating versatility and more skating style options than conventional roller skates. In-line skates are more useful on sidewalks, streets, bicycle paths, and parking lots. The skates are similar to ice skates but with wheels in place of the blade and in-line skating techniques traditionally are similar to ice skating style. In-line skates enable users to participate in hockey games, acrobatics, races, and many other athletic activities.

The art of conventional roller skates developed several mechanisms for selectively preventing the front pair of wheels from rotating in a rearward direction. One of these mechanisms is shown in U.S. Pat. No. 4,553,767 Robjent et al in which a pawl can be moved by the skate operator into or out of a ratcheting position in which a spring biases the pawl into contact with teeth that are attached to and rotate with the wheels. When the pawl is in the ratcheting position, wheel rotation in the forward direction moves the pawl away from the teeth, but when the wheels attempt to rotate in the rearward direction, the pawl is drawn into the teeth to effectively lock the wheel and prevent rotation in the rearward direction.

A different mechanism for achieving the same result is shown in U.S. Pat. No. 4,526,389 Chase in which supplemental rollers are mounted eccentrically on a shaft positioned behind the front wheels of a roller skate. A spring forces the rollers into contact with the front wheels. During forward rotation of the wheels of the roller skate, the rollers rotate eccentrically away from the wheels and enable normal operation. Rearward rotation of the wheels causes the rollers to rotate into engagement with the wheels and thereby causes braking to prevent any significant rearward motion of the skate.

U.S. Pat. No. 4,289,323 Roberts provides a disk shaped rotor attached to the front wheel of a roller skate and a disk shaped stator attached to a rotationally stationary portion of the skates. A bearing cage supporting several ball bearings is located between the rotor and stator. The stator has a plurality of teardrop-shaped cavities that receive the ball bearings and permit the balls to rotate freely in a forward direction. When the wheel is rotated in a rearward direction, the balls are forced along a ramp in the cavity that eventually locks the rotor and stator and prevents rearward movement. Roberts also shows an arrangement in which ball bearings are arranged cylindrically around an axle. The ball bearings are located in a teardrop shaped cavity. Under certain forces, the ball bearings roll into the narrower dimensions of the cavity and wedging action prevents further wheel rotation.

Advantages taught by the art for these roller skates include facilitated learning to roller skate, improved ability to skate uphill and move up stairways, undefined improvements in safety and reductions in energy requirements and bodily strain, and improved skating style.

SUMMARY OF THE INVENTION

This invention provides an in-line skate with a new and distinct structure that achieves and exceeds these advantages for in-line skaters. The invention is for an in-line roller skate having a boot suitable for fitting on a foot of a user, a support member extending longitudinally along the bottom of the boot, and at least one intermediate wheel rotatably mounted on the support member and capable of supporting the boot and its user, and the invention comprises at least one control wheel rotatably mounted on the support member longitudinally of the intermediate wheel. The control wheel is positioned so that the lowest point of its circumference is closer to the boot than the lowest point of the circumference of the intermediate wheel. Accordingly the circumference of the control wheel is displaced above and is not in contact with the surface over which the skate is rolling when the skate is in an at-rest position and during normal operation. Rotation inhibiting means associated with the control wheel inhibit rotation of the control wheel when the control wheel is applying force in one direction to the surface below the boot but enable rotation more readily when the control wheel is applying force to the surface in the opposite direction.

The preferred rotation inhibiting means is a particular needle bearing construction that locks under the properly applied forces. When the control wheel is located forward of the intermediate wheel, the needle bearing is designed to lock when the control wheel is applying rearward forces to the surface over which the skate is rolling, and the control wheel then provides improved thrusting and control. When the control wheel is located rearward of the intermediate wheel, the needle bearing is designed to lock when the control wheel is applying forward forces to the surface, and the control wheel then provides improved braking.

Generally in-line skates of this invention have at least two intermediate wheels. The lowest points of the circumferences of these intermediate wheels identify a plane that is largely parallel to the sole of the boot and that becomes the plane of the surface on which the boot is positioned.

Use of the skates of this invention is enhanced if the rotation inhibiting means locks the control wheel from rotation completely and quickly when required, that is, within a very small amount of angular rotation when the appropriate force is applied. At the same time the rotation inhibiting means must provide minimal resistance to rolling when forces are being applied in the opposite direction.

A very effective needle bearing assembly is one having spacers made of polymeric material interposed between the needle bearings. A leaf spring is located between each spacer and its adjacent needle bearing and the spring urges the needle bearing toward a pad on the next spacer. The pad is shaped to conform to the needle bearing and the corresponding shapes of the pad and the needle bearing provide a large contact area between the needle bearing and the pad. Friction forces generated by this contact area serves to grip the needle bearing firmly and the combined gripping forces of the several needle bearings and pads serves to lock the bearing assembly under anticipated forces.

Lockup of this needle bearing assembly occurs within approximately one or two degrees of rotation under forces in the locking direction. Moreover, the needle bearing assembly has good sensitivity and locks up quickly under low forces.

When forces on the needle bearings are in the direction opposite to those that produce the desired lockup, the needle bearings overcome the effects of the leaf springs and move out of significant contact with the pads. The bearing assembly then rolls freely and imposes very little rolling resistance to the wheel.

When all of the wheels have the same diameter, the control wheel is mounted on an axle that is displaced upwardly, or toward the boot, from the axle that mounts the intermediate wheel or wheels. Displacement toward the boot of the lowest point of the circumference of the control wheel also can be achieved by providing a control wheel with a diameter less than that of the intermediate wheels. The displacement of the lowest point of the circumference of the control wheel from the lowest point of the circumference of the intermediate wheel or wheels is largely a matter of individual preference.

BRIEF DESCRIPTION OF THE DRAWINGS

FIG. 2 is taken along line 2—2 of FIG. 1.

DESCRIPTION OF THE PREFERRED EMBODIMENTS

Figure 1:
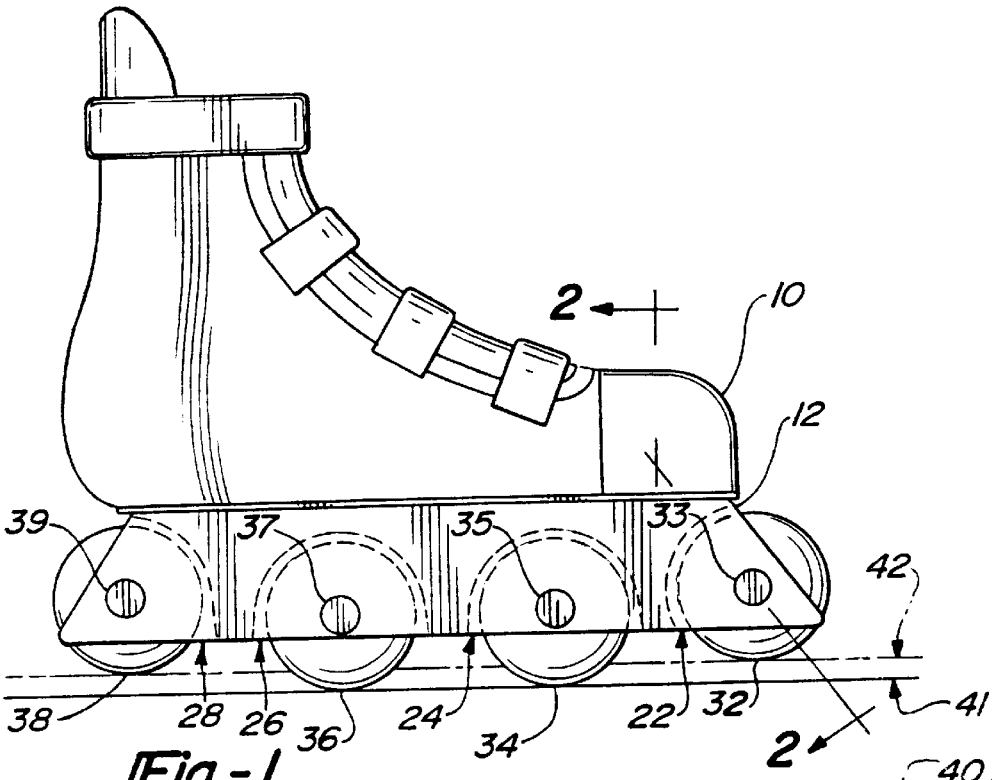
FIG. 1 is a side view of an in-line roller skate in an at-rest position having four wheels located along a longitudinal support member.

Referring to FIG. 1, an in-line skate has a boot 10 that fits on the foot of a user. Boot 10 can be attached snugly to the foot by means of conventional laces, clasps, or snaps as appropriate (not shown). An elongated support member or truck 12 is attached to the bottom of boot 10 and extends longitudinally along the bottom, and for approximately the length of the bottom, of the boot.

Figure 2:
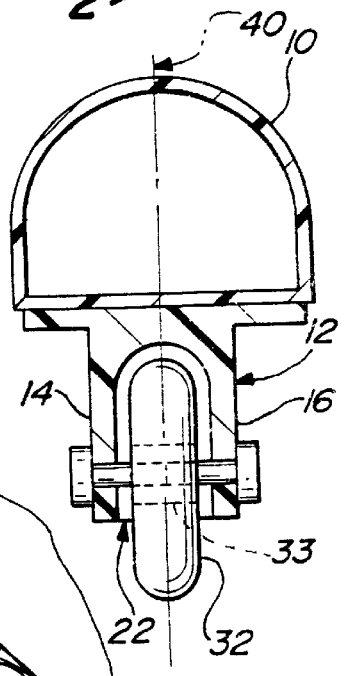
FIG. 2 is a cross section taken through the axle and bearing assembly of a control wheel positioned as the forward wheel of the roller skate of FIG. 1.

Truck 12 typically is made of a structurally tough polymeric material and has depending skirt portions 14 and 16 (FIG. 2) that define four wheel wells spaced along its lower portion and identified as forward well 22, intermediate well 24, intermediate well 26, and rearward well 28.

A first or forward control wheel 32 is rotatably mounted in forward wheel well 22 on an axle and bearing assembly 33 that is supported in the lower edges of skirt portions 14 and 16 and extends laterally through the wheel well. In similar fashion, an intermediate wheel 34 is rotatably mounted in intermediate well 24 on an axle and bearing assembly 35, another intermediate wheel 36 is rotatably mounted in intermediate well 26 on an axle and bearing assembly 37, and a second or rearward control wheel 38 is rotatably mounted in rearward well 28 on an axle and bearing assembly 39.

The axes of axle and bearing assemblies 33, 35, 37, and 39 are parallel to each other, and all of wheels 32, 34, 36, and 38 rotate in the same rotational plane, which extends perpendicularly to boot 10 and essentially bisects boot 10. The rotational plane is identified in FIG. 2 by numeral 40.

As shown in FIG. 1, intermediate wheels 34 and 36 are mounted on truck 12 so that the lowest points of their circumferences lie in a plane 41 that is displaced from boot 10. In the at-rest position shown in FIG. 1, plane 41 is a surface that supports the skate and on which the skate would roll under normal conditions.

In contrast the lowest point of the circumference of forward control wheel 32 is in a plane 42 that is above plane 41 and is closer to boot 10 than plane 41. This is accomplished by locating axle and bearing assembly 33 closer to boot 10 than axle and bearing assemblies 35 and 37.

Similarly, rearward control wheel 38 is mounted to truck 12 so that the lowest point of its circumference is above plane 41 and closer to boot 10 than plane 41. This is accomplished by locating axle and bearing assembly 39 closer to boot 10 than axle and bearing assemblies 35 and 37.

Axle and bearing assemblies 35 and 37 can be of conventional construction. These typically consist of a ball bearing assembly (not shown) that is supported rotatably on an axle (not shown). A needle bearing assembly can be used if desired.

Figure 3:
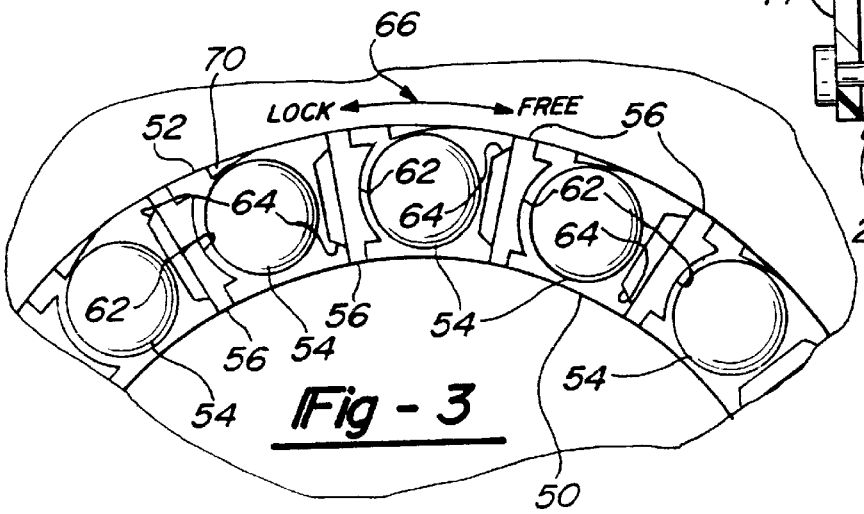
FIG. 3 is a cross-section of a needle bearing assembly used in the control wheel of the roller skate and showing the arrangement of the needle bearings and the polymeric spacers that provide the locking function.

The axle and bearing assembly 33 for forward control wheel 32 differs materially from the axle and bearing assemblies for the intermediate wheels. Referring to FIG. 3, axle and bearing assembly 33 comprises an inner race 50, an outer shell 52, and a plurality of cylindrical needle bearings 54 mounted between race 50 and shell 52. Needle bearings 54 are located in a cage (not shown) and are separated from each other by plastic spacers 56 having a forward surface 58 and a rearward surface 60.

The forward surface 58 of each spacer has a pad 62 with a surface contour corresponding to the cylindrical surface of the adjacent needle bearing. A leaf spring 64 is mounted on the rearward surfaces 60 of each spacer and extends into contact with the trailing needle bearing 54. Each leaf spring exerts a force on the trailing needle bearing that urges the bearing into contact with the pad on the forward surface of the trailing spacer. Each of pads 62 extends along most of the length of each spacer 56, and this length coupled with the surface contour of the pad makes available a relatively large surface area for contact with an adjacent needle bearing.

During operation of the in-line roller skates of this invention, skating motion of the user in a forward direction causes wheels 32, 34, 36, and 38 to rotate clockwise in FIG. 1. As shown more particularly in FIG. 3, the effect of this clockwise rotation in the forward control bearing assembly exerts clockwise forces on the outer shell 52 that are sufficient to urge needle bearings 54 into springs 64 and deflect springs 64 sufficiently to move the needle bearings out of contract with pads 62. The bearing assembly thus rolls freely in the FREE direction of arrow 66.

When the user wants additional acceleration, the user shifts his or her weight forward slightly so that forward control wheel 32 contacts the surface of plane 41. The user then directs forces to forward control wheel that would tend to rotate wheel 32 counterclockwise. These forces act through outer shell 52 to urge needle bearings 54 in the opposite direction in which the forces complement the forces of springs 64.

Needle bearings 54 move into contract with pads 62 almost immediately and with virtually undetectable counterclockwise rotation. The friction between the bearings and the pads is applied over a relatively large area, and friction forces serve to stop counterclockwise rotation of the needle bearings completely. This also stops rotation of the forward bearing assembly in a counterclockwise direction and the forward control wheel becomes locked against counterclockwise rotation.

The user then can exert strong thrusting forces through control wheel 32 and thereby accelerate rapidly. The user can obtain increased stability and control when at rest simply by placing a light rearward force on the forward control wheel. Users also can move uphill more readily and with less strain.

Similar added elements of control can be achieved with establishing rearward wheel 38 as a control wheel, either in addition to the forward control wheel system as described above or independently as the only control wheel. Rearward control wheel 38 can be set up to operate as described above but with locking action occurring in reverse, that is so that it locks when the wheel is applying force to the surface below the wheel in a forward direction.

The rearward control wheel also can be set up to provide a new set of control features. This is achieved by using an axle and bearing assembly 39 identical to axle and bearing assembly 33 but mounting the axle and bearing assembly by turning it 180 degrees.

Axle and bearing assembly 39 then is installed in truck 12 and rear wheel 38 so that rear wheel 38 rotates freely when it is applying rearward forces to the surface below, but locks when it is applying forces in a forward direction. Rearward control wheel 38 then enables the user to achieve braking actions by leaning backward slightly to place the wheel into contact with the surface below and exerting a forward force through the wheel to the surface.

An in-line roller skate with both a forward control wheel 32 and a rearward control wheel 39 set up as described offers thrusting actions through the forward control wheel when the user leans forward slightly, and braking actions through the rearward control wheel when the user leans backward slightly.

Several variations can be implemented in the in-line roller skate of this invention to emphasize or minimize the control effects. To improve lockup under heavier loads, a ramp 70 can be added to shell 52 (see FIG. 3) so that counterclockwise rotation of shell 52 clamps needle bearings 54 between the shell 52 and race 50. The displacement of the control wheel above the normal at-rest plane of the intermediate wheels can be adjustable to accommodate the preferences of individual users. The support member can be longer than the bottom of the boot and typically is longer for speed skaters and endurance skating, or it can be shorter for acrobatic performance.

I claim:

1. An in-line roller skate having a boot (10) suitable for fitting on a foot of a user, a support member (12) extending longitudinally along the bottom of the boot, and at least one intermediate wheel (34) rotatably mounted on the support member and capable of supporting the boot and its user, comprising:

at least one control wheel (32) rotatably mounted on the support member outwardly of the intermediate wheel, said control wheel being located so that the lowest point of its circumference is closer to the boot than the lowest point of the circumference of the intermediate wheel, and rotation inhibiting means (33) associated with said control wheel (32) for inhibiting rotation of the control wheel when the control wheel is applying force in one direction to the surface below the boot but enabling rotation more readily when the control wheel is applying force to the surface in the opposite direction, said rotation inhibiting means comprising a bearing assembly (33) that locks the control wheel when the control wheel is applying force to the surface below the boot in a rearward direction.

2. The roller skate of claim 1 in which the rotation inhibiting means is a needle bearing assembly (33) supportably mounting the control wheel, said needle bearing assembly comprising an inner race (50), an exterior housing (52), a plurality of needle bearings (54), and polymeric spacers (56) located between said needle bearings, said needle bearings contacting the spacers when the control wheel is applying force to the surface below the boot.

3. The roller skate of claim 2 in which the polymeric spacers (56) have pads (62) on a surface facing an adjacent roller bearing, said pads having a contour corresponding to the cylindrical surface of the roller bearing, said needle bearings contacting said pads when the control wheel is applying force to the surface below the boot.

4. The roller skate of claim 3 in which the polymeric spacers (56) have spring means (64) on the surfaces opposite said pads, said spring means bearing on the adjacent roller bearing to move the roller bearing into contact with the pad when the control wheel is applying force to the surface below the boot.

5. The roller skate of claim 4 in which the control wheel (32) is forward of an intermediate wheel, and the needle bearing assembly locks the forward wheel against rotation when the forward wheel is applying rearward force to the surface below the boot.

6. The roller skate of claim 5 comprising a second control wheel (38), said second control wheel being rearward of an intermediate wheel and being located so that the lowest point of its circumference is closer to the boot than the lowest point of the circumference of an intermediate wheel, and second rotation inhibiting means (39) associated with the second control wheel for inhibiting rotation of the second control wheel when the second control wheel is applying forward force to the surface below the boot.

7. The roller skate of claim 6 in which the second rotation inhibiting means (39) comprises a needle bearing assembly supportably mounting the second control wheel, said needle bearing assembly comprising an exterior housing, an inner race, a cage including polymeric spacers, and a plurality of needle bearings, said needle bearings contacting the spacers when the second control wheel is applying forward force to the surface below the boot.

8. The roller skate of claim 1 comprising a second control wheel (38), said second control wheel being rearward of an intermediate wheel and being located so that the lowest point of its circumference is closer to the boot than the lowest point of the circumference of an intermediate wheel, and second rotation inhibiting means associated with the second control wheel for inhibiting rotation of the second control wheel when the second control wheel is applying forward force to the surface below the boot.

9. The in-line roller skate of claim 1 in which the control wheel is rotatably mounted on the support member forwardly of the intermediate wheel.

10. The in-line roller skate of claim 1 in which the bearing assembly comprises needle bearings and polymeric spacers that contact the needle bearings to provide locking action.

* * * * *